US008139002B2

(12) United States Patent
Kim et al.

(10) Patent No.: US 8,139,002 B2
(45) Date of Patent: Mar. 20, 2012

(54) ORGANIC LIGHT EMITTING DIODE DISPLAY AND DRIVING METHOD THEREOF

(75) Inventors: In Hwan Kim, Seoul (KR); Seung Chan Byun, Incheon (KR); Jin Hyoung Kim, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 791 days.

(21) Appl. No.: 11/819,276

(22) Filed: Jun. 26, 2007

(65) Prior Publication Data

US 2008/0001863 A1 Jan. 3, 2008

(30) Foreign Application Priority Data

Jun. 30, 2006 (KR) ..... 10-2006-0060760

(51) Int. Cl.

| | |
|---|---|
| ***G09G 3/30*** | (2006.01) |
| ***G09G 5/00*** | (2006.01) |
| ***G09G 3/10*** | (2006.01) |
| ***H01J 29/16*** | (2006.01) |

(52) U.S. Cl. ..... 345/77; 345/76; 345/82; 345/204; 313/463; 315/169.3

(58) Field of Classification Search ..... 345/76–83, 345/204; 315/169.3; 313/463
See application file for complete search history.

(56) References Cited

U.S. PATENT DOCUMENTS

| | | | | |
|---|---|---|---|---|
| 4,652,872 | A | 3/1987 | Fujita | 340/781 |
| 4,691,144 | A * | 9/1987 | King et al. | 315/169.3 |
| 4,975,691 | A * | 12/1990 | Lee | 345/79 |
| 5,786,797 | A * | 7/1998 | Kapoor et al. | 345/79 |
| 6,023,259 | A * | 2/2000 | Howard et al. | 345/76 |
| 7,187,373 | B2 * | 3/2007 | Tobita | 345/211 |
| 2002/0044109 | A1 * | 4/2002 | Kimura | 345/76 |
| 2003/0193490 | A1 * | 10/2003 | Liu et al. | 345/204 |
| 2003/0193499 | A1 * | 10/2003 | Gao | 345/420 |
| 2004/0124780 | A1 * | 7/2004 | Ha et al. | 315/169.3 |

(Continued)

FOREIGN PATENT DOCUMENTS

JP 2001-164360 * 6/2000

(Continued)

*Primary Examiner* — Lun-Yi Lao
*Assistant Examiner* — Jarurat Suteerawongsa
(74) *Attorney, Agent, or Firm* — Morgan, Lewis & Bockius LLP

(57) ABSTRACT

An organic light emitting diode display for removing a voltage which is charged into a gate electrode of a driving transistor before a current frame is changed to a next frame is disclosed. In the organic light emitting diode display, a display panel has a plurality of pixels that include an organic light emitting diode. A timing controller controls a driving timing of the inputted video data and controls a supply timing of a refresh voltage. A data driver converts a digital data which is outputted from the timing controller for a current frame into an analog data voltage to supply it to the pixels, and then supplies the refresh voltage to pixels which are selected among the pixels in accordance with a control of the timing controller. And a gate driver primarily supplies a scanning pulse for a first horizontal period of a current frame to select the pixels to be supplied with a data, and then secondarily supplies a scanning pulse for a second horizontal period of a current frame to select pixels to be supplied with the refresh voltage among the pixels in accordance with a control of the timing controller.

11 Claims, 4 Drawing Sheets

U.S. PATENT DOCUMENTS

2004/0256617 A1* 12/2004 Yamada et al. ..... 257/59
2004/0263440 A1* 12/2004 Kimura et al. ..... 345/76
2006/0038758 A1* 2/2006 Routley et al. ..... 345/81
2006/0044301 A1* 3/2006 Ha ..... 345/209
2006/0066536 A1* 3/2006 Ota et al. ..... 345/76
2006/0158396 A1* 7/2006 Jo ..... 345/76
2006/0238475 A1* 10/2006 Oh ..... 345/92
2006/0244689 A1* 11/2006 Osame et al. ..... 345/76
2007/0040785 A1* 2/2007 Edwards et al. ..... 345/92
2007/0080906 A1* 4/2007 Tanabe ..... 345/76
2007/0216315 A1* 9/2007 Kawabe ..... 315/169.3

FOREIGN PATENT DOCUMENTS

WO WO 2005/034072 * 4/2005

* cited by examiner

ORGANIC LIGHT EMITTING DIODE DISPLAY AND DRIVING METHOD THEREOF

This application claims the benefit of Korean Patent Application No. P2006-060760 in Korea on Jun. 30, 2006, which is hereby incorporated by reference.

BACKGROUND OF THE INVENTION

1. Field of the Invention

The present invention relates to an organic light emitting diode display, and more particularly to an organic light emitting diode display that is adaptive for removing a voltage which is charged into a gate electrode of a driving transistor before a current frame is changed to a next frame, and a driving method thereof.

2. Description of the Related Art

Recently, there have been developed various flat panel display devices reduced in weight and bulk that is capable of eliminating disadvantages of a cathode ray tube. Such flat panel display devices include a liquid crystal display (hereinafter, referred to as "LCD"), a field emission display (hereinafter, referred to as "FED"), a plasma display panel (hereinafter, referred to as "PDP"), and an electro-luminescence (hereinafter, referred to as "EL) display device, etc.

The EL display device among the flat panel display devices is a self-luminous device which radiates a fluorescent material by a re-combination of an electron and a hole. The EL display device is largely classified into an inorganic EL display device which uses an inorganic compound and an organic EL display device which uses an organic compound depending upon the fluorescent material. Since such an EL display device has been highlighted as a post-generation display owing to its advantage of a low voltage driving, a self-luminous, a thin profile, a wide viewing angle, a fast response speed, and a high contrast, etc.

The organic EL display device is comprised of an electron injection layer, an electron transport layer, a light emitting layer, a hole transport layer, and a hole injection layer. Herein, the electron injection layer is disposed between a cathode and an anode. In the organic EL display device, if a predetermined voltage is applied between an anode and a cathode, an electron which is generated from a cathode moves toward a light emitting layer via the electron injection layer and the electron transport layer, and a hole which is generated from an anode moves toward a light emitting layer via the hole injection layer and the hole transport layer. Thus, an electron and a hole which are supplied from the electron transport layer and the hole transport layer are re-combined to generate a light in the organic light emitting layer.

A circuit configuration of each pixel which is formed at an organic light emitting diode display of the related art using an organic EL will be described with reference to FIG. 1.

FIG. 1 is an equivalent circuit diagram showing a pixel which is included in an organic light emitting diode display of the related art.

Referring to FIG. 1, each pixel of the organic light emitting diode display includes a switch transistor S_TR1, a storage capacitor Cst, an organic light emitting diode OLED, and a driving transistor D_TR1. Herein, The switch transistor S_TR1 is turned-on by a scanning pulse which is supplied via a gate line GL to switch a data voltage which is supplied via a data line DL. The storage capacitor Cst charges a data voltage which is supplied via the switch transistor S_TR1. The organic light emitting diode OLED is turned-on by a driving current which is supplied from a power terminal to which a high potential power voltage VDD is applied to be radiated. The driving transistor D_TR1 is turned-on by a data voltage which is supplied via the switch transistor S_TR1 or a charged voltage of the storage capacitor Cst to drive the organic light emitting diode OLED.

The switch transistor S_TR1 is a NMOS transistor having a gate electrode, a drain electrode, and a source electrode. Herein, the gate electrode is connected to the gate line GL. The drain electrode is connected to the data line DL. The source electrode is commonly connected to the storage capacitor Cst and the gate electrode of the driving transistor D_TR1. The switch transistor S_TRL is turned-on by a scanning pulse which is supplied via the gate line GL to supply a data voltage which is supplied via the data line DL to the storage capacitor Cst and the driving transistor D_TR1.

One side of the storage capacitor Cst is commonly connected to the switch transistor S_TR1 and a gate electrode of the driving transistor D_TR1, and the other side of the storage capacitor Cst is connected to a ground. The storage capacitor Cst is charged by a data voltage which is supplied via the switch transistor S_TR1. The storage capacitor Cst discharges a discharge voltage thereof to hold a gate voltage of the driving transistor D_TR1 from a point that a data voltage, which is supplied via the switch transistor S_TR1, is not applied to a gate electrode of the driving transistor D_TR1. Accordingly, although a data voltage which is supplied via the switch transistor S_TR1 is not supplied, the driving transistor D_TR1 is maintained as a turned-on state by a discharge voltage of the storage capacitor Cst for a holding period when is hold by the storage capacitor Cst. Herein, a point that a data voltage, which is supplied via the switch transistor S_TR1, is not applied to a gate electrode of the driving transistor D_TR1 is a point that a gate voltage of the driving transistor D_TR1 is dropped.

The organic light emitting diode OLED has an anode and a cathode. In this case, the anode is connected to a power terminal to which a high potential power voltage VDD is applied. The cathode is connected to a drain electrode of the driving transistor D_TR1.

The driving transistor D_TR1 is a NMOS transistor having a gate electrode, a drain electrode, and a source electrode. Herein, the gate electrode is commonly connected to a source electrode of the switch transistor S_TR1 and the switch transistor S_TR1. The drain electrode is connected to a cathode of the organic light emitting diode OLED. The source electrode is connected to a ground. The driving transistor D_TR1 is turned-on by a data voltage which is supplied to a gate electrode via the switch transistor S_TR1 or a discharge voltage of the switch transistor S-TR1 which is supplied to a gate electrode to switch a driving current which is flowed into the organic light emitting diode OLED to a ground. In this way, a driving current which is flowed into the organic light emitting diode OLED is switched to a ground, so that the organic light emitting diode OLED is radiated by a driving current which is generated by a high potential power voltage VDD.

In the organic light emitting diode display of the related art including the pixels that have the above-mentioned equivalent circuit, although the driving transistor D_TR1 is changed to a turned-off state from a state in which the driving transistor D_TR1 is turned-on by a DC voltage applied to a gate electrode, a gate discharge voltage is maintained. Thus, there is a problem in that the driving transistor D_TR1 is degradated. Specially, in the organic light emitting diode display of the related art, since a voltage which is charged to a gate electrode of the driving transistor D_TR1 at the previous frame is maintained to a current frame, there is a problem in that a residual image is generated on a screen.

SUMMARY OF THE INVENTION

The present invention is to solve the above-mentioned problem. Accordingly, it is an object of the present invention to provide an organic light emitting diode display that is adaptive for removing a voltage which is charged into a gate electrode of a driving transistor before a current frame is changed to a next frame, and a driving method thereof.

It is another object of the present invention to provide an organic light emitting diode display that is adaptive for removing a gate discharge voltage of a driving transistor for one frame to prevent a degradation of a driving transistor, and a driving method thereof.

It is still another object of the present invention to provide an organic light emitting diode display that is adaptive for removing a gate discharge voltage of a driving transistor before a current frame is changed to a next frame to remove a residual image of a screen, and a driving method thereof.

In order to achieve these and other objects of the invention, an organic light emitting diode display according to an embodiment of the present invention comprises a display panel having a plurality of pixels that include an organic light emitting diode; a timing controller controlling a driving timing of the inputted video data and controlling a supply timing of a refresh voltage; a data driver converting a digital data which is outputted from the timing controller for a current frame into an analog data voltage to supply it to the pixels, and then supplying the refresh voltage to pixels which are selected among the pixels in accordance with a control of the timing controller; and a gate driver primarily supplying a scanning pulse for a first horizontal period of a current frame to select the pixels to be supplied with a data, and then secondarily supplying a scanning pulse for a second horizontal period of a current frame to select pixels to be supplied with the refresh voltage among the pixels in accordance with a control of the timing controller.

The refresh voltage is a voltage of 0V.

The refresh voltage is a negative polarity voltage.

The timing controller generates the refresh voltage to apply it to the data driver.

The organic light emitting diode display of the present invention further includes a refresh voltage generator to which a power voltage is applied to generate the refresh voltage.

The timing controller supplies a mask signal to the gate driver to adjust the first horizontal period and the second horizontal period.

The first horizontal period and the second horizontal period are a half horizontal period, respectively.

The first horizontal period is different from the second horizontal period.

The gate driver supplies a scanning pulse for the second horizontal period to select all pixels which are formed at the display panel.

The gate driver does not supply a scanning pulse for the second horizontal period to at least one pixel among pixels which are formed at the display panel.

A method of driving an organic light emitting diode display, including a display panel having a plurality of pixels that include an organic light emitting diode, the method comprises generating a refresh voltage; primarily supplying a scanning pulse for a first horizontal period for a current frame to select the pixels to be supplied with a data; converting a digital data which is inputted for the current frame into an analog data voltage to supply it to pixels which are selected by a scanning pulse for the first horizontal period; secondarily supplying a scanning pulse for a second horizontal period of the current frame to select pixels to be supplied with the refresh voltage among the pixels; and supplying the refresh voltage to pixels which are selected by a scanning pulse for the second horizontal period of the current frame.

In the method, the refresh voltage is a voltage of 0V.

In the method, the refresh voltage is a negative polarity voltage.

In the method, the first horizontal period and the second horizontal period are a half horizontal period, respectively.

In the method, the first horizontal period is different from the second horizontal period.

In the method, all pixels which are formed at the display panel are selected by supplying a scanning pulse for the second horizontal period in the step of selecting pixels to be supplied with the refresh voltage.

In the method, a scanning pulse is not supplied to at least one pixel among pixels which are formed at the display panel for the second horizontal period in the step of selecting pixels to be supplied with the refresh voltage.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Hereinafter, a flat display panel and a fabricating method thereof according to the present invention will be described with reference to the accompanying drawings.

Figure 2:
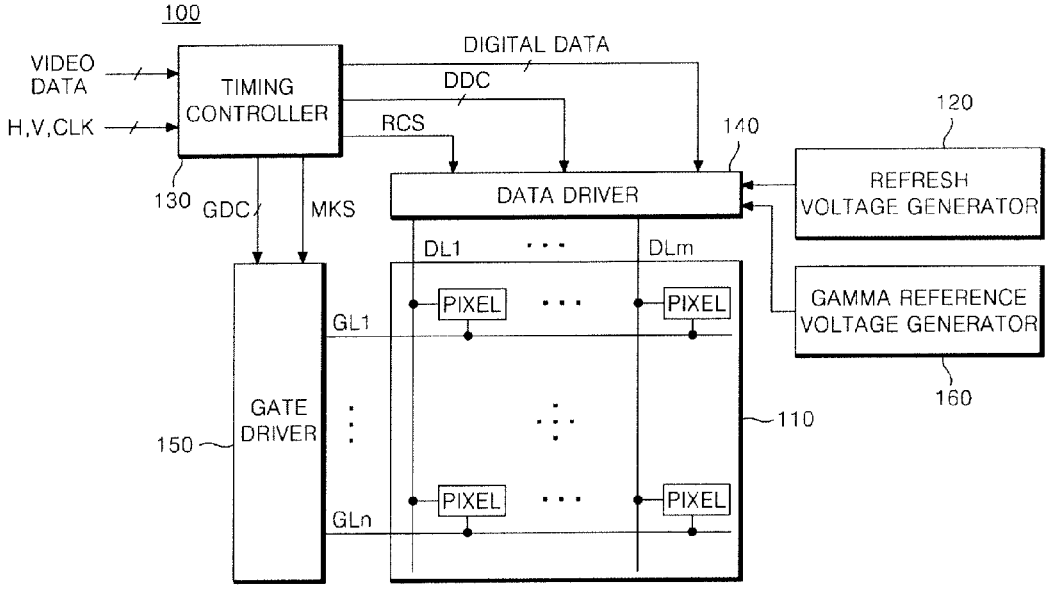
FIG. 2 is a diagram showing a configuration of an organic light emitting diode display according to an embodiment of the present invention.

FIG. 2 is a diagram showing a configuration of an organic light emitting diode display according to an embodiment of the present invention.

Referring to FIG. 2, an organic light emitting diode display 100 of the present invention includes a display panel 110, a refresh voltage generator 120, a timing controller 130, a data driver 140, and a gate driver 150. Herein, the refresh voltage generator 120 is applied with a power voltage to generate a refresh voltage for removing a gate discharge voltage of the driving transistor D_TR1. The timing controller 130 controls a driving timing of a video data which is inputted with a system and, at the same time controls a supply timing of a refresh voltage. The data driver 140 converts a digital data which is inputted from the timing controller 130 for a current frame into an analog data voltage to supply it to pixels of the display panel 110, and then supply a refresh voltage from the refresh voltage generator 120 to pixels of the display panel 110 in accordance with a data driving control signal DDC from the timing controller 130. The gate driver 150 sequentially supplies a scanning pulse for a half horizontal period to the gate lines GL1 to GLn for a current frame, and then sequentially supplies a scanning pulse for a half horizontal period to the gate lines GL5 to GLn in accordance with a gate driving control signal from the timing controller 130.

Figure 1:
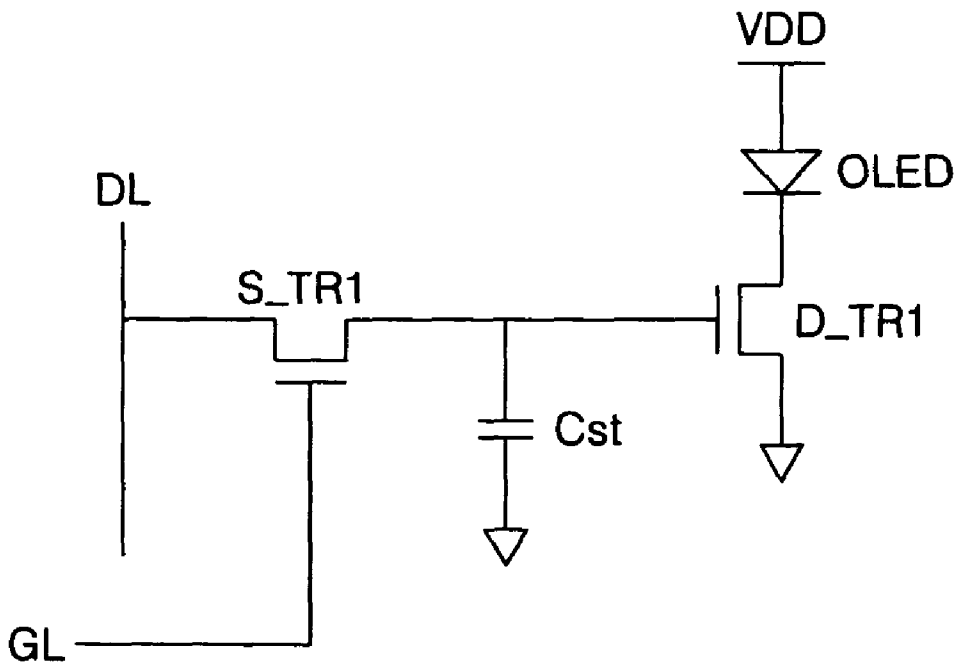
FIG. 1 RELATED ART
FIG. 1 is an equivalent circuit diagram showing a pixel which is included in an organic light emitting diode display of the related art.

A plurality of data lines DL1 to DLm and a plurality of gate lines GL1 to GLn are crossed to be vertical to each other. A pixel that includes the organic light emitting diode OLED is formed at a crossing part thereof. An equivalent circuit in FIG. 1 is formed at a pixel.

The refresh voltage generator 120 is applied with a power voltage to generate a refresh voltage for removing a gate discharge voltage of the driving transistor D_TR1, thereby supplying it to the data driver 140. Herein, the refresh voltage generator 120 supplies a refresh voltage of 0V or a refresh voltage of negative polarity. This is because only DC voltage of positive polarity is supplied to a gate electrode of the driving transistor D_TR1, a refresh voltage of 0V or a refresh voltage of negative polarity is supplied to the driving transistor D_TR1 to remove a gate discharge voltage of the driving transistor D_TR1. On the other hand, in the present invention, the refresh voltage generator 120 generates a refresh voltage. However, its application is not limited to this. For example, the timing controller 130 may generate a refresh voltage to supply it to the data driver 140.

The timing controller 130 is inputted with a video data from a system such as a TV set or a computer monitor, etc., to supply a digital data to the data driver 140 and, at the same time control a driving of the data.

Further, the timing controller 130 generates a data driving control signal DDC, a refresh control signal RCS, a gate driving control signal GDC, and a mask signal MKS using a horizontal/vertical synchronizing signals H and V from a system in accordance with a clock signal CLK from a system. The data driving control signal DDC and the refresh control signal RCS are supplied to the data driver 140. The gate driving control signal GDC and the mask signal MKS are supplied to the gate driver 150. Herein, the data driving control signal DDC includes a source shift clock SSC, a source start pulse SSP, and a source output enable signal SOE, etc. The gate driving control signal GDC includes a gate start pulse GSP and a gate output enable signal GOE, etc. Specially, the refresh control signal RCS controls a supply timing of a refresh voltage of the data driver 140. The mask signal MKS controls a horizontal period of a scanning pulse.

The data driver 140 converts a digital data which is inputted from the timing controller 130 into an analog data voltage in response to a data driving control signal DDC which is supplied from the timing controller 130 to supply it to pixels of the display panel 110. Herein, the data driver 140 converts a digital data which is supplied via the timing controller 130 into an analog data voltage on the basis of a gamma reference voltage which is supplied from a gamma reference voltage generator 160 to supply it to the data lines DL1 to DLm. Herein, an analog data voltage is realized as a gray scale at the organic light emitting diode OLED of the display panel 110.

The data driver 140 supplies a data at a current frame, and then supplies a refresh voltage to pixels which are selected among the pixels of the display panel 110 for a current frame in accordance with a refresh control signal RCS from the timing controller 130.

Figure 3:
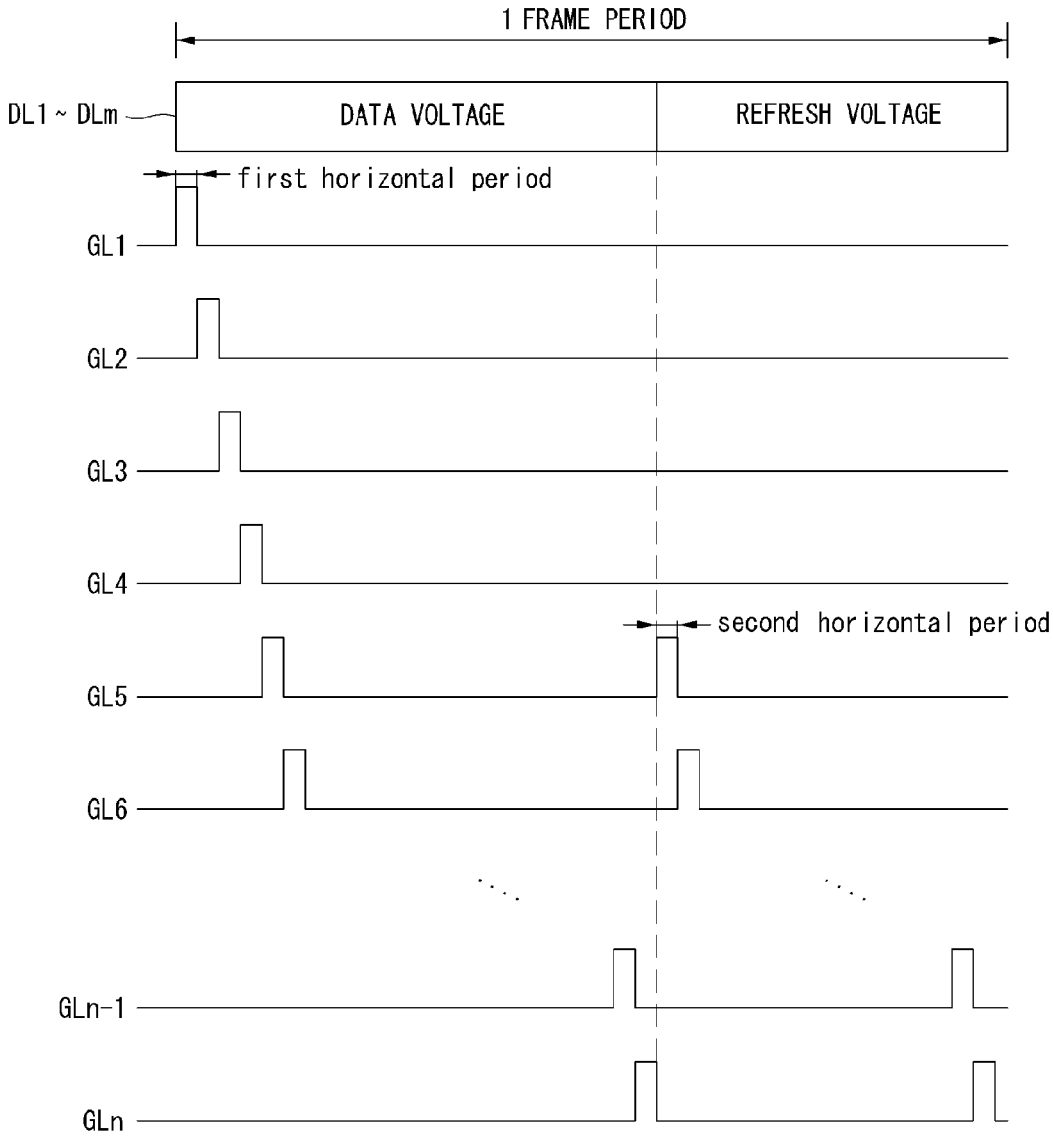
FIG. 3 is a diagram showing an operating characteristics of the organic light emitting diode display according to the present invention.

Referring to FIG. 3, the data driver 130 supplies a data to pixels which are selected by a scanning pulse. In this case, the scanning pulse is sequentially supplied to the gate lines GL1 to GLn from the gate driver 150 for a half horizontal period of a current frame. If a data is supplied to the pixels, the data driver 130 supplies a refresh voltage to pixels which are selected by a scanning pulse. In this case, the scanning pulse is sequentially supplied to the gate lines GL5 to GLn from the gate driver 150 for a half horizontal period of a current frame. Herein, the supplied refresh voltage is supplied to a gate electrode of the driving transistor D_TR1 to remove a gate discharge voltage of a current frame. Accordingly, the present invention can prevent a degradation of the driving transistor and, at the same time remove a residual image of a screen.

Figure 4:
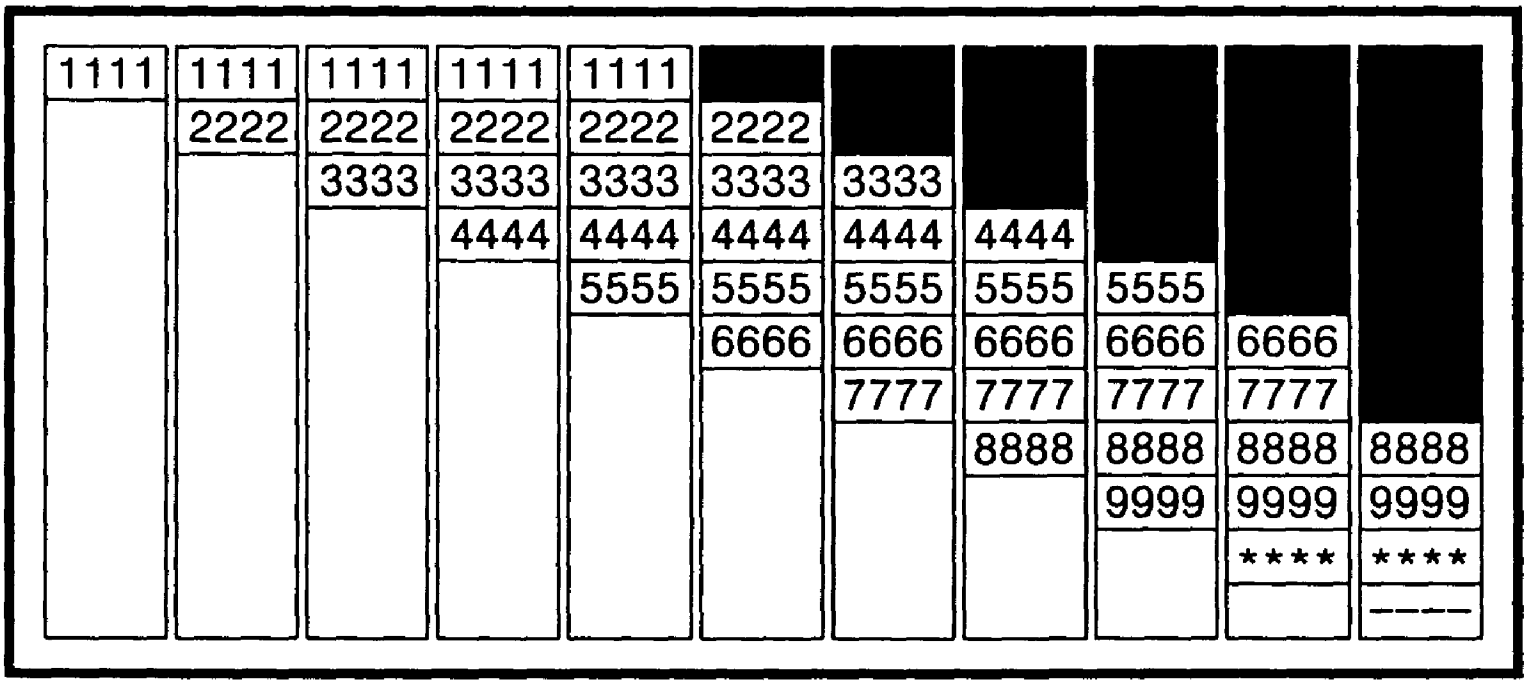
FIG. 4 is a diagram showing a gray scale characteristics of the organic light emitting diode display according to the present invention.

The gate driver 150 sequentially supplies a scanning pulse for supplying a data to the gate lines GL1 to GLn for a current frame, and then sequentially supplies a scanning pulse for refreshing to the gate lines GL5 to GLn for a current frame in response to a gate driving control signal GDC and a gate shift clock GSC which are supplied from the timing controller 130 as shown in FIG. 3. In this case, the gate driver 150 sequentially supplies a scanning pulse for the first horizontal period of a half horizontal period, and then sequentially supplies a scanning pulse for the second horizontal period of a half horizontal period in accordance with a mask signal MKS from the timing controller 130. In this way, if a data is supplied, and then a refresh voltage is supplied for a current frame, a gray scale value of data is realized at each pixel of the display panel 110 as shown in FIG. 4. Specially, an area where a gray scale value of data is not realized and is darkly displayed is an area where a refresh voltage is supplied.

On the other hand, in the present invention, the gate driver 150 selects a pixel to be supplied with a data by supplying a scanning pulse for a half horizontal period and, at the same time selects a pixel to be supplied with a refresh voltage by supplying a scanning pulse for a half horizontal period in accordance with a mask signal MKS. However, a period of a scanning pulse is not limited to this. For another example, the gate driver 150 may select a pixel to be supplied with a data by supplying a scanning pulse for a two thirds horizontal period and, at the same time may select a pixel to be supplied with a refresh voltage by supplying a scanning pulse for a one third horizontal period in accordance with a mask signal MKS.

Furthermore, in the present invention, a scanning pulse for refreshing is supplied to only gate lines GL5 to GLn. However, its application is not limited to this. For another example, a scanning pulse for refreshing may be sequentially supplied to all gate lines GL1 to GLn.

As described above, the present invention supplies a data voltage, and then supplies a refresh voltage for one frame to remove a gate discharge voltage of the driving transistor. As a result, the present invention can prevent a degradation of the driving transistor and remove a residual image of a screen.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. An organic light emitting diode display, comprising:

a display panel having a plurality of data lines, a plurality of gate lines, and a plurality of pixels, wherein each of the pixels include an organic light emitting diode, a switch transistor and a driving transistor, wherein the switch transistor is turned-on by a scanning pulse from the gate line, and the driving transistor is turned-on by an analog data voltage to drive the organic light emitting diode, wherein the switch transistor and the driving transistors have a same channel type;

a timing controller configured to control a driving timing of the inputted video data and controlling a supply timing of a refresh voltage;

a refresh voltage generator configured to generate the refresh voltage for removing a gate discharge voltage of the driving transistor;

a gamma reference voltage generator configured to generate a gamma reference voltage;

a data driver configured to convert a digital data which is outputted from the timing controller for a current frame into the analog data voltage on the basis of the gamma reference voltage to supply the analog data voltage to a gate electrode of the driving transistor via the data lines, and then supply the refresh voltage from the refresh voltage generator to the gate electrode of the driving transistor via the data lines in accordance with a control of the timing controller; and a gate driver configured to sequentially supply a first scanning pulse for a first horizontal period in the current frame to all of the gate lines and then sequentially supply a second scanning pulse for a second horizontal period in the current frame to gate lines excepting some of gate lines positioned at upper portion of the display panel, in accordance with a control of the timing controller, wherein the first scanning pulse selects all of the pixels to be supplied with the analog data voltage, and wherein the second scanning pulse selects some of the pixels to be supplied with the refresh voltage.

2. The organic light emitting diode display according to claim 1, wherein the refresh voltage is a voltage of 0V.

3. The organic light emitting diode display according to claim 1, wherein the refresh voltage is a negative polarity voltage.

4. The organic light emitting diode display according to claim 1, wherein the timing controller supplies a mask signal to the gate driver to adjust the first horizontal period and the second horizontal period.

5. The organic light emitting diode display according to claim 4, wherein the first horizontal period and the second horizontal period are a half horizontal period, respectively.

6. The organic light emitting diode display according to claim 4, wherein the first horizontal period is different from the second horizontal period.

7. A method of driving an organic light emitting diode display, including a display panel having a plurality of data lines, a plurality of gate lines, and a plurality of pixels, wherein each of the pixels include an organic light emitting diode and a driving transistor, and wherein the switch transistor is turned-on by a scanning pulse from the gate line, and the driving transistor is turned-on by an analog data voltage to drive the organic light emitting diode, wherein the switch transistor and the driving transistors have a same channel type, the method comprises:

generating a refresh voltage for removing a gate discharge voltage of the driving transistor;

generating a gamma reference voltage;

sequentially supply a first scanning pulse for a first horizontal period in the current frame to all of the gate lines to select all of the pixels to be supplied with an analog data voltage;

converting a digital data which is inputted for the current frame into an analog data voltage on the basis of the gamma reference voltage to supply the analog data voltage to the gate electrode of the driving transistor which are selected by the first scanning pulse via the data lines;

sequentially supply a second scanning pulse for a second horizontal in the current frame period to gate lines excepting some of gate lines positioned at upper portion of the display panel to select some of the pixels to be supplied with the refresh voltage; and supplying the refresh voltage to the gate electrode of the driving transistor which are selected by the second scanning pulse via the data lines.

8. The method of driving the organic light emitting diode display according to claim 7, wherein the refresh voltage is a voltage of 0V.

9. The method of driving the organic light emitting diode display according to claim 7, wherein the refresh voltage is a negative polarity voltage.

10. The method of driving the organic light emitting diode display according to claim 7, wherein the first horizontal period and the second horizontal period are a half horizontal period, respectively.

11. The method of driving the organic light emitting diode display according to claim 7, wherein the first horizontal period is different from the second horizontal period.

* * * * *